United States Patent [19]

Boyajian

[11] 4,188,891

[45] Feb. 19, 1980

[54] PLANT SUPPORT

[76] Inventor: William M. Boyajian, 269 Huron Ave., Cambridge, Mass. 02138

[21] Appl. No.: 924,930

[22] Filed: Jul. 17, 1978

[51] Int. Cl.[2] ..... A47B 23/00

[52] U.S. Cl. ..... 108/42; 211/88; 108/92; 248/236

[58] Field of Search ..... 108/42, 92, 96, 101, 108/97; 211/90, 88; 248/236, 208

[56] References Cited

U.S. PATENT DOCUMENTS

| | | | |
|---|---|---|---|
| 170,115 | 11/1875 | Roberts | 248/23 C |
| 179,071 | 6/1876 | Shirley | 211/88 |
| 640,567 | 1/1900 | Johnson | 248/236 X |
| 678,031 | 7/1901 | Peach | 108/92 X |
| 721,488 | 2/1903 | Witham et al. | 248/208 X |
| 727,423 | 5/1903 | Oppenheimer | 248/236 |
| 841,574 | 1/1907 | Sandhofer | 108/92 |
| 858,112 | 6/1907 | Smart | 108/42 |
| 2,059,011 | 10/1936 | Moewes | 248/236 X |
| 2,510,175 | 6/1950 | Hess et al. | 248/208 X |

*Primary Examiner*—Roy D. Frazier
*Assistant Examiner*—Peter A. Aschenbrenner
*Attorney, Agent, or Firm*—Kenway & Jenney

[57] ABSTRACT

Disclosed is a support structure for holding house plants or the like in position to receive optimal sunlight at a window. The structure comprises a pair of elongate support members which rest on the window sill and extend upwardly and inwardly into the room. C-hooks attached to the base of the support members pass over the nosing of the window trim and prevent slippage; cables extend between eyes screwed into the window track and the top of the support members. The support members hold one or more shelves, each of which comprise a plurality of parallel rails extending horizontally between rail holding brackets. The brackets define holes dimensioned to interfit with the support members and to slide therealong. When a load is placed on the rails, vertical slippage of the shelves is prevented by a gripping action exerted by the rail holding brackets on the support members. The structure is both vertically and horizontally adjustable, fits variously sized windows, is easily assembled and disassembled without tools, does not interfere with the operation of the window sash, blinds, shades etc., and can be conveniently stored or transported as a compact collection of dowels or the like.

7 Claims, 4 Drawing Figures

PLANT SUPPORT

BACKGROUND OF THE INVENTION

This invention relates to a structure for supporting potted plants or the like in position about a window. More particularly, it relates to an easily assembled, vertically and horizontally adjustable shelf structure useful with windows of various dimensions.

The recent upsurge in popularity of interior greenery has created a need for an attractive, inexpensive structure for mounting collections of hanging and other potted plants about a window or other light source in position to optimize lighting conditions. Ideally, such a structure should have hanging locations as well as shelf space, should itself block as little light as possible, and should have adjustability features. To be successful, such a product should also be able to accommodate variously dimensioned windows, should not interfere with the operation of the window sash itself or related fixtures and, when removed, should not leave scars on the window trim.

Currently, plants are hung from chains anchored in the ceiling adjacent the window or from brackets screwed into the window frame. Glass shelves suitable for attachment to the meeting bars of a double hung window are also available. Examples of shelves of this general type are disclosed in U.S. Pat. Nos. 179,071; 640,567; and 678,031.

SUMMARY OF THE INVENTION

The instant invention comprises an easily assembled and disassembled support structure for holding a collection of house plants or the like in position at a window such that the plants can receive optimal sunlight. The structure comprises at least two support members, each of which has a load bearing end for resting on a point on the sill of a window, an elongate intermediate portion, and means for receiving a cable connected to the frame of the window. When installed, the support members extend from the sill upwardly and inwardly into the room, and the cables are in tension. A rail holding bracket having a longitudinal axis extends substantially horizontally from each of the support members. The brackets each define a plurality of parallel grooves or holes normal to the axis (herein generically referred to as openings), and a hole perpendicular to the openings which passes through the bracket at an angle to the axis less than 90°. The hole is dimensioned to snugly interfit with the intermediate portion of the support member and to slide therealong. An array of elongate support rails extend in parallel between brackets on adjacent support members to form a shelf. The rails are received and held in place on the brackets in the openings.

With this structure, the height of the shelf is vertically adjusted as the rail holding brackets are slid up or down the support members. The location of the support members relative to the shelf is adjusted as the rails are slid horizontally through the grooves or holes in the brackets. Potted plants can be placed on the rails or hung from a single rail. When a load is placed on a shelf, downward slippage of the shelf is prevented by a gripping action exerted by the bracket on the support member.

In preferred embodiments, the structure includes means to prevent slippage of the load bearing end of the support members toward the sash of the window. This preferably comprises C-hooks or the like which are attached to the support members and pass over the nosing of the sill of the window. Also, holes may be included in the support members so that pegs can be inserted for additional shelf support and for maintaining the position of the shelves when no load is present. The structure preferably includes two support members and at least two shelves.

Accordingly, it is an object of the invention to provide a plant support structure for use in connection with a window which blocks little or no light coming into the room and provides optimal illumination for plants. Another object is to provide such a structure which is easily assembled and disassembled without tools, may be stored and transported as a compact package when disassembled, and is both vertically and horizontally adjustable. Still another object is to provide a plant support structure which, when installed, will not hinder proper operation of venetian blinds, shades, or the window sash itself, and leaves no permanent scars on the finish woodwork. Yet another object is to provide a plant support structure which transfers the weight of the plant as a compression load to the sill of the window as opposed to a shear stress to a threaded ceiling hook or the like and which has other unique structural advantages.

These and other objects and features of the invention will be apparent from the following description of a preferred embodiment and from the drawing.

BRIEF DESCRIPTION OF THE DRAWING

Like reference characters in the respective figures indicate corresponding parts.

DESCRIPTION OF THE PREFERRED EMBODIMENT

Figure 1:
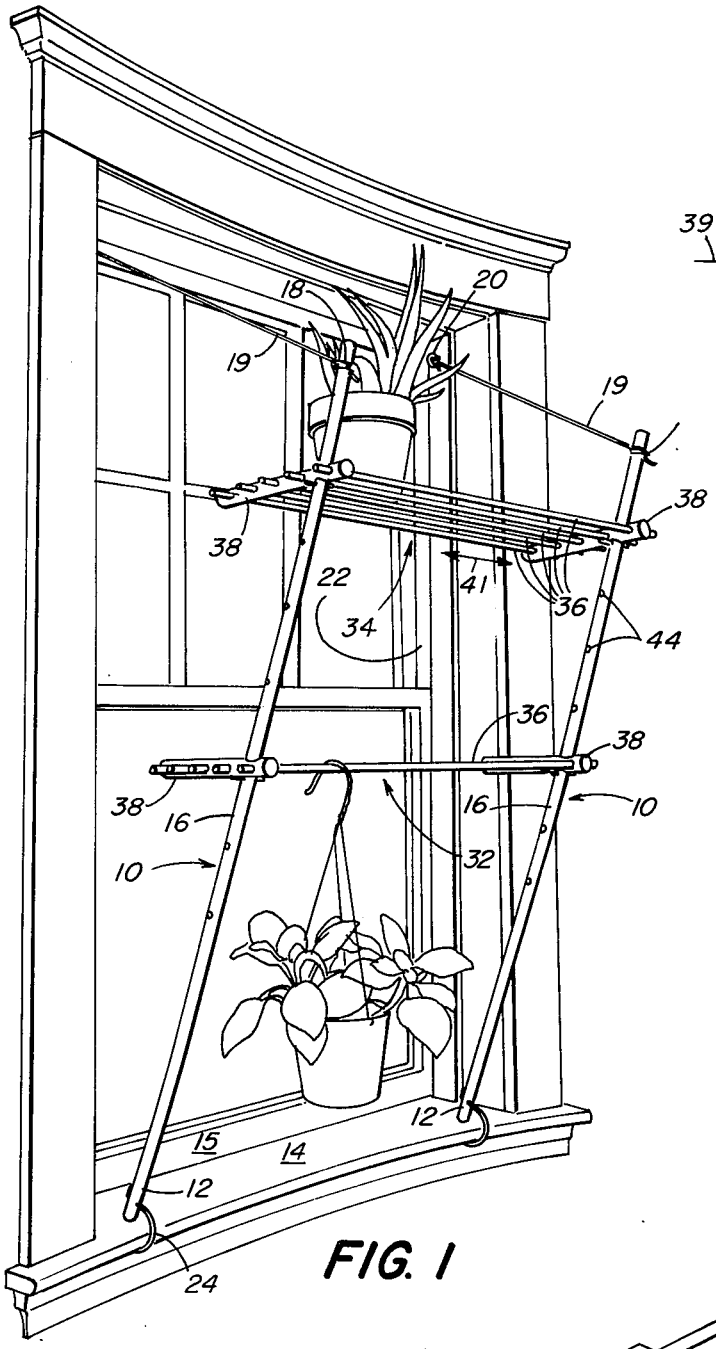
FIG. 1 is a perspective view of a structure embodying the invention mounted at a window.

Referring to FIG. 1, there is shown a support structure embodying the invention installed in a conventional double-hung window. The structure comprises a pair of support members 10 (which may comprise one or more joined sections) and a pair of shelves 32 and 34. Each of the support members has a load bearing end 12 resting on the window sill 14, an elongate intermediate section 16, and a hole 18 for receiving a cable 19. The cable is connected to the frame of the window by, for example, an eye 20 threaded into the upper portion of the sash guide 22. As shown, the support members extend upwardly and away from the plane of the window defining an angle $\theta$ to the vertical of, for example, 20°. The load bearing end 12 of support members 10 is rounded to minimize the possibility of marring sill 14. To prevent slippage of the support members 10 towards sash 15, a C-hook 24 is fastened to the support member, passes about the nose 26 of sill 14, and buts against window trim 28. An elastomeric bumper 30 prevents abrasion of trim 28.

Shelves 32 and 34 each comprise an array of rails 36 supported by a pair of rail holding brackets 38. As shown in greater detail in FIG. 2, the brackets have a central axis 39 and a plurality of holes 40, normal to the axis, which snugly interfit with rails 36. The rails can slide back and forth through holes 40 in the direction of arrow 41 (FIG. 1). Rail holding bracket 38 is mounted on the intermediate section 16 of support member 10. Support member 10 passes through a hole 42 in bracket 38 which, as shown, forms an acute angle $\alpha$ to axis 39. Ideally, $\theta+\alpha=90°$: this results in axis 39 and shelves 32 and 34 being precisely horizontal.

Figure 2:
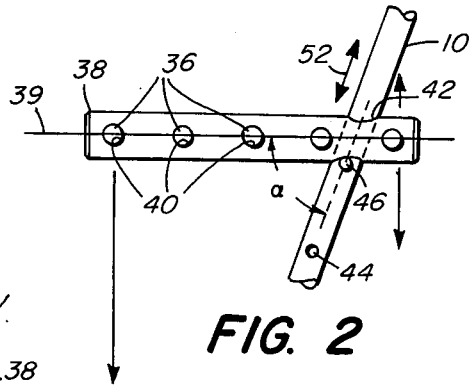
FIG. 2 is a detailed view of the rail holding piece of the structure of FIG. 1.

As can be appreciated from FIG. 2, a load such as a potted plant (shown in FIG. 1) hung from a rail 36, located either inside or outside support member 10, results in the exertion of a gripping action of the rail holding bracket 38 onto support member 10 as the bracket tips and binds into the support member. Depending on the coefficient of friction between surfaces of the material from which the structure is made, on the cross-sectional shape selected for the bracket and the support member, and on the magnitude of the load, the binding force may or may not be sufficient to maintain the vertical position of the loaded shelf assembly. In cases where the gripping action is insufficient, and in order to support the shelf assembly in the absence of a load, a plurality of regularly spaced holes such as are shown in FIGS. 1 and 2 at 44 are provided. These accept pegs 46 which, although of small diameter, are more than sufficient to assure that slippage will not occur.

Figure 3:
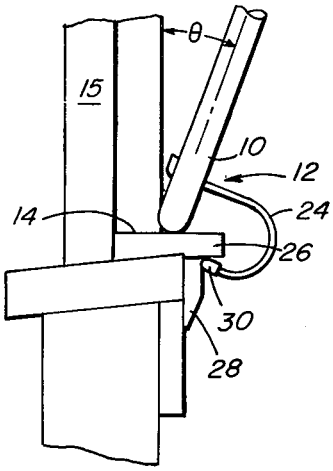
FIG. 3 is a detailed view of the load bearing end of the support member of the structure of FIG. 1 showing the window sill area in cross section.
Figure 4:
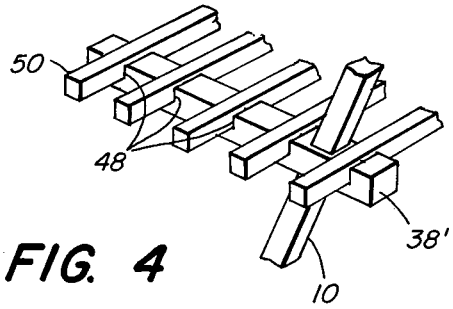
FIG. 4 is a detailed perspective view of an alternative design for the bracket shown in FIG. 2.

Referring to FIG. 4, a second embodiment of the invention is shown. Here, the openings in bracket 38' take the form of grooves 48 traversing the top of a bracket having a square cross-section. Square rails 50 fit snugly in grooves 48 to form the shelf assembly. As with rails 36', these can slide axially and are thus adjustable. The circular cross-section illustrated in FIGS. 1, 2, and 3 is preferred over the square and rectangular cross sections of FIG. 4 because of the well-known structural advantages inherent in the circular cross-section. Further, holes 40 are preferred over grooves 48 because they tend to hold adjacent support members together and promote unitary interaction of the whole structure.

From the foregoing it will be apparent that the plant support of the invention can be easily assembled and disassembled and stored compactly as a collection of dowels. To install the structure, eyes 20 are threaded into the window sash track 22, and cables 19 (e.g., rope or chain) are attached to the eyes. Brackets 38 are threaded along support members 10. The support members are then attached to the cables and placed in position on a window sill 14. The C-hooks, if used, are positioned about the nosing 26 of window sill 14. The lengths of cable 19 are then adjusted so that brackets 38 are parallel and lie substantially horizontally. Next, after the height of holding brackets on adjacent support members has been equalized, rails 36 are threaded through holes 40. If, for example, the window lies at the corner of a room, the rails can be slid horizontally through the holes 40 of brackets 38 to obviate this problem. Obviously, windows of different widths will require different distances between adjacent support members.

The shelves are adjusted vertically as desired by sliding rail holding brackets 38 in the direction of arrow 52. If desired, pegs 46 are placed in holes 44, and the shelf assembly is merely rested on the pegs. The assembly of the embodiment of FIG. 4 is identical to that of the structure of FIG. 1, except that the square cross-section rails 36 are friction fitted into the grooves 48.

Hanging plants may be suspended from any of the rails 36, and plants or other decorative objects can be placed directly on the array of rails. In contrast, for example, to the conventional hook screwed into the ceiling of the room above the window, support for the plants does not depend on the resistance to shear of a threaded screw. Furthermore, the stresses which induce sagging of a bracket of the type which is screwed directly into the top cross-piece of the window trim are avoided. Instead, on the order of 70% of the weight exerted by the load on the support structure is transmitted to the window sill 14 through support members 10; the other 30% is absorbed in tension in cables 19. The window trim is not marred in any way, and normal operation of the window sash 15 or of venetian blinds or shades is not hindered.

From the foregoing it will be apparent that many modifications can be made in the structure of the invention without departing from the spirit or scope thereof. Thus, for example, the number of shelves and the number of support members may be varied as desired and as window dimensions require. The material from which the various components of the structure are made can be metal, plastic, and other conventional materials. Extruded tubings and the like can be used with success. A preferred material is hardwood such as birch which has adequate strength and is aesthetically pleasant. In one successful birch structure, each of the support members 10 comprise a pair of $\frac{3}{4}$ inch dowels, connected by a mortise and tenon joint, rails 36 comprise $\frac{1}{2}$ inch dowels, and the brackets 38 comprise $1\frac{1}{8}$ inch dowels. Quarter inch pegs are used. It should also be obvious that various cross sections of the support members and other components of the structure are possible in lieu of those discussed specifically herein.

Accordingly, other embodiments are within the following claims.

What is claimed is:

1. An easily assembled and disassembled support structure for holding house plants or the like in position to receive optimal sunlight at a window, said structure comprising:

A. at least two support members, each of which has a load bearing end for resting on a point on the sill of a window, an elongate intermediate section extending upwardly and angled away from the plane of the window, and means for receiving a cable located upwardly of said intermediate section;

B. cables for connection with the frame of the window and said cable receiving means for maintaining the position of said support members;

C. a rail holding bracket having a longitudinal axis extending from each of said support members, said bracket defining a plurality of parallel openings normal to said axis and a hole dimensioned to interfit with said intermediate section, perpendicular to said openings, and passing through the bracket at an angle to said axis less than 90°; and D. an array of parallel elongate support rails extending between the brackets and held in said openings to form a shelf, the shelf being vertically adjustable as the brackets are slid along said support members, and the location of said support members relative to the rails being adjustable as said rails are slid horizontally through said openings.

2. The structure of claim 1 wherein the openings are holes.

3. The structure of claim 1 wherein the openings are grooves.

4. The structure of claim 1 further including means to prevent slippage of said load bearing end of said support members toward the sash of the window.

5. The structure of claim 4 wherein said means comprises a C-hook attached to said structure adjacent the load bearing end of said support members and passing over the nose of the sill of the window.

6. The structure of claim 1 further including pegs for supporting the shelf in a selected vertical position.

7. The structure of claim 1 comprising a plurality of sets of rail holding brackets and a corresponding plurality of rail arrays whereby such structure includes a plurality of shelves.

* * * * *